US011190885B2

(12) United States Patent
Agac

(10) Patent No.: US 11,190,885 B2
(45) Date of Patent: Nov. 30, 2021

(54) MODULAR HEARING AID

(71) Applicant: EAR-TECHNIC GMBH, Essen (DE)

(72) Inventor: Mehmet Emin Agac, Essen (DE)

(73) Assignee: EAR-TECHNIC GMBH, Essen (DE)

( * ) Notice: Subject to any disclaimer, the term of this patent is extended or adjusted under 35 U.S.C. 154(b) by 0 days.

(21) Appl. No.: 16/767,183

(22) PCT Filed: Nov. 27, 2018

(86) PCT No.: PCT/EP2018/082733
§ 371 (c)(1),
(2) Date: May 27, 2020

(87) PCT Pub. No.: WO2019/105949
PCT Pub. Date: Jun. 6, 2019

(65) Prior Publication Data

US 2020/0389741 A1 Dec. 10, 2020

(30) Foreign Application Priority Data

Nov. 28, 2017 (DE) ..... 10 2017 128 117.7

(51) Int. Cl.
*H04R 25/00* (2006.01)

(52) U.S. Cl.
CPC ..... *H04R 25/556* (2013.01); *H04R 25/60* (2013.01)

(58) Field of Classification Search
CPC ..... H04R 25/556; H04R 25/60; H04R 2225/0213; H04R 2225/021; H04R 2225/0216
(Continued)

(56) References Cited

U.S. PATENT DOCUMENTS

2008/0107292 A1 5/2008 Kornagel
2011/0243357 A1 10/2011 Probst
(Continued)

FOREIGN PATENT DOCUMENTS

DE 1 180 417 B1 10/1964
DE 29801567 U1 5/1998
(Continued)

OTHER PUBLICATIONS

International Search Report and Written Opinion in International Application No. PCT/EP2018/082733, with English translation, dated Mar. 21, 2019 (30 pages).

*Primary Examiner* — Phylesha Dabney
(74) *Attorney, Agent, or Firm* — Nixon Peabody LLP

(57) ABSTRACT

A modular hearing aid with an amplifier module that can be worn behind the ear, an ear module for arrangement in the ear, and a cable sleeve module for connecting the amplifier module to the ear module. A microphone for picking up sounds and a speaker are arranged relative to the ear module. The hearing aid is suitable for near-deaf people, has a low feedback tendency and no resonance effects of the amplified signal, and provides a particularly distortion-free, unadulterated, undelayed and high-quality acoustic signal. The cable sleeve module is designed to forward electrical signals picked up the microphone to the amplifier module and to forward amplified electrical signals from the amplifier module to the ear module. The ear module, cable sleeve module and amplifier module are detachably connected to one another and form a modular system in which each of the parts can be exchanged.

10 Claims, 10 Drawing Sheets

Figure 1:
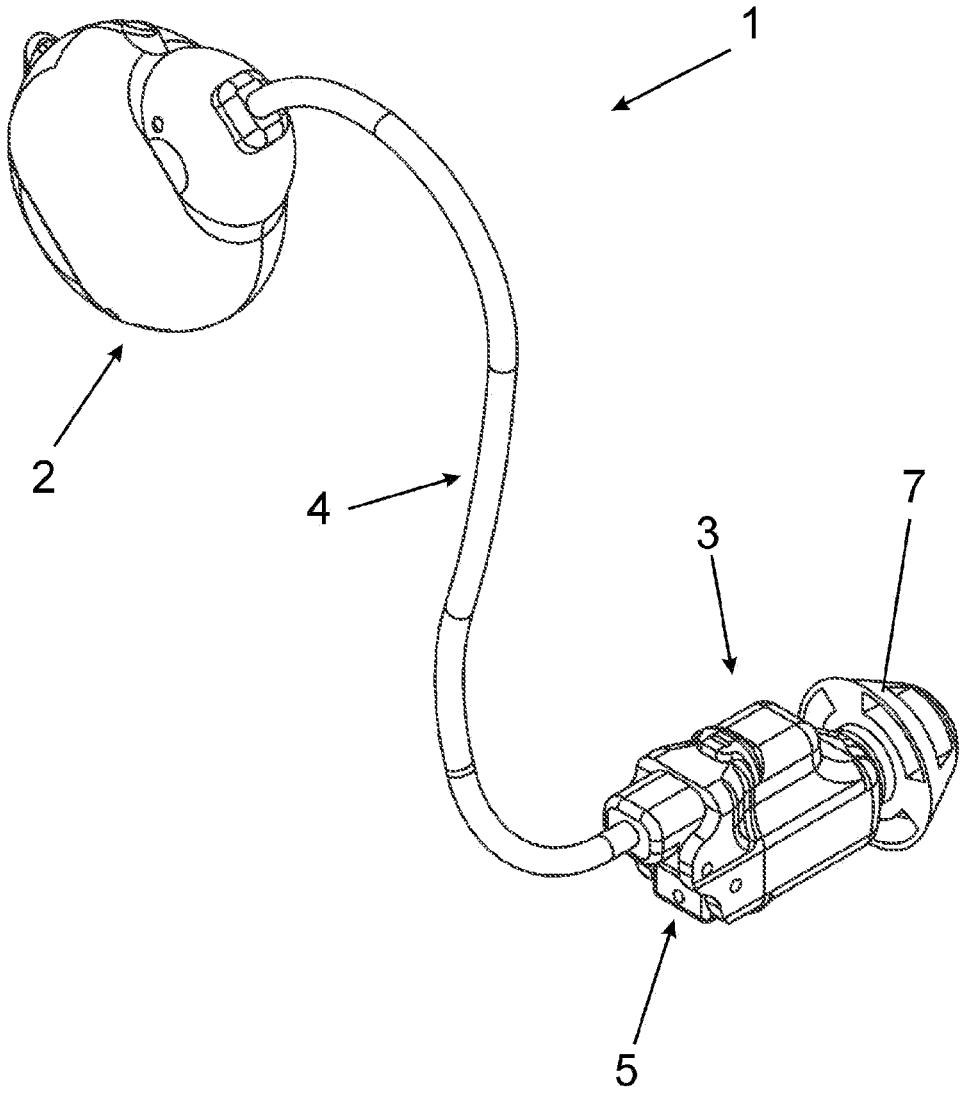

(58) Field of Classification Search
USPC ..... 381/312
See application file for complete search history.

(56) References Cited

U.S. PATENT DOCUMENTS

| | | | | |
|---|---|---|---|---|
| 2012/0014549 | A1 | 1/2012 | Higgins | |
| 2016/0381472 | A1* | 12/2016 | Feeley | H04R 25/607 381/322 |
| 2017/0078803 | A1 | 3/2017 | Rasmussen | |
| 2018/0146307 | A1* | 5/2018 | Petersen | H04R 25/407 |

FOREIGN PATENT DOCUMENTS

| | | | |
|---|---|---|---|
| DE | 102006046700 | A1 | 4/2008 |
| EP | 2545719 | B1 | 11/2013 |

* cited by examiner

MODULAR HEARING AID

CROSS-REFERENCE TO RELATED APPLICATIONS

This application is a U.S. National Stage of International Application No. PCT/EP2018/082733, filed Nov. 27, 2018, which claims the benefit of Germany Patent Application No. 10 2017 128 117.7, filed Nov. 28, 2017, both of which are incorporated herein by reference in their entireties.

The invention relates to a modular hearing aid with an amplifier module that can be worn behind the ear, an ear module for arrangement in the ear, and a cable conduit module for connecting the amplifier module to the ear module, wherein a microphone for picking up sounds and a speaker are arranged in or on the ear module.

Hearing aids are known from the prior art in many designs. Suitable hearing aids are thus normally used in order to compensate for insufficient hearing ability, or respectively a functional deficit in the hearing organ of a human.

First of all, a basic construction of a hearing aid is known from the prior art and is worn entirely and exclusively in the ear. Given the arrangement completely within the auditory canal, these hearing aids have numerous disadvantages, however. First of all, the variety of technical designs is restricted given the necessary compact construction, which results in a short battery life and low performance of the employed electronics; consequently given the low initial sound level, these hearing aids are only suitable for individuals who are only slightly to moderately hard of hearing. Moreover, these in-ear hearing aids have a strong tendency to feedback. Finally with this construction, a so-called occlusion effect frequently occurs, as a result of which the user perceives his own voice as muffled and amplified since the auditory canal is closed by the hearing aid, which results in a low acceptance of the hearing aid by the user. Finally, this construction promotes the formation of ear wax, which also reinforces the occlusion effect.

Moreover hearing aids are known from the prior art which are worn behind the ear, or respectively placed above on the auricle, and with which the sounds picked up by the hearing aid arranged behind the ear are fed by a sound channel to the ear, or respectively to an earmold arranged in the auditory canal. Undesirable feedback also occurs with these hearing aids however, and an occlusion effect moreover frequently occurs when an earmold is arranged in the auditory canal. In addition, the acoustic quality of the picked up and amplified signal is poor due to the microphone arranged behind the ear. Finally, the conduction of sound in the sound channel causes undesirable resonances which further reduces the acoustic quality.

Finally, embodiments of hearing aids are known from the prior art which are basically worn behind the ear, and in which the microphone, the amplifier unit, the battery in particular as well as the majority of the other electronics are worn in a unit behind the ear. Moreover, an external speaker is arranged in the auditory canal, however, which is connected by a thin cable to the unit worn behind the ear and only converts the amplified electrical signals into an acoustic signal within the auditory canal of the user. However, this embodiment of hearing aids also has the disadvantage that the microphone is arranged behind the ear, and therefore distortions, a frequency shift as well as a delay in the picked up signal can occur.

The document DE 10 2006 046 700 A1 discloses a hearing aid with a housing that can be worn behind the ear, a signal processing apparatus arranged within the housing and having an optoelectric transformer and at least one optical microphone, wherein the optical microphone is arranged outside of the housing and can be placed in the auricle or in the auditory canal. Furthermore, the optical microphone for optical signal transmission is connected via an optical waveguide to the signal processing apparatus.

The object of the invention is therefore to provide a hearing aid which is suitable even for persons who are very hard of hearing, which has a low tendency to feedback and no resonance effects of the amplified signal, and which provides a particularly distortion-free, true, non-delayed and high-quality acoustic signal.

The object is achieved according to the invention by a hearing aid according to claim 1.

Advantageous further embodiments of the inventions are specified in the dependent claims.

The modular hearing aid according to the invention has an amplifier module that can be worn behind the ear, an ear module to be arranged in the ear, in particular in the auditory canal, and a cable conduit module for connecting the amplifier module to the ear module, wherein at least one microphone is arranged in or on the ear module for picking up sounds, and wherein the cable conduit module is made to forward signals picked up by means of the microphone to the amplifier module, as well as simultaneously to forward amplified signals from the amplifier module to the ear module.

By arranging the microphone on the ear module, a significant improvement in the acoustic quality can be achieved in a particularly easy manner in comparison to a microphone arranged behind the ear. The acoustic signal picked up and reproduced amplified in the ear is thus perceived as being particularly natural since the signal is picked up in the area of the position of the ear that is provided for forwarding the sound into the auditory canal even when hearing is unassisted. In particular, the signal picked up by means of the microphone has fewer distortions or other adulterations. Moreover, given the amplifier module which can be arranged behind the ear, there is sufficient installation space for complex electronics and/or for a sufficiently large battery. Finally, undesirable resonance effects are avoided by electronically forwarding the signal from the microphone to the amplifier module and then to the ear module.

A hearing aid is in principle a device which is suitable to at least partially compensate for insufficient hearing ability, or respectively a functional deficit in the hearing organ of a human by picking up ambient sounds and forwarding them amplified to the human ear, or respectively reproducing them there. In this respect, the hearing aid according to the invention is termed a TIE hearing aid, wherein TIE stands for the English expression, "transducer in ear". Preferably, the hearing aid is thus made as an independent functional unit which does not require any connection to other devices to function, for example to an external energy supply, to a control unit or to other devices for transmitting or receiving data or signals. Particularly preferably, a hearing aid is an independently functioning device which can be arranged in the region of a single ear of a human.

A modular hearing aid is first of all only understood to mean that the hearing aid is made of several modules with a particular function, wherein the individual modules interact and are functionally connected to each other. Preferably, the individual modules are also mechanically connected to each other. Also preferably, several modules are exchangeable with each other with an identical function.

The amplifier module according to the invention comprises a processing unit at least to amplify the acoustic signals picked up by means of the microphone, and preferably also a control unit to control the hearing aid, in particular to operate the hearing aid in different operating states, or respectively with different operating properties. Particularly preferably, only the amplifier module is provided in the hearing aid according to the invention to process, in particular amplify the acoustic signal and/or to control the entire hearing aid.

The amplifier module can in principle have any shape and size and be made of any material as long as it remains possible to wear the amplifier module on the ear, preferably at least sectionally, and particularly preferably completely behind the ear. Preferably, the amplifier module has a substantially closed housing. Also preferably, the housing is thus made of a plastic and/or has a skin tone. Most preferably, the amplifier module has a housing shape and/or size adapted to be worn behind the ear. Any number of flaps and closable openings can thus be arranged in the housing of the amplifier module. Preferably, the amplifier module has a battery flap in the housing which can be opened to change the battery.

Also preferably, the amplifier module has a programming interface that is particularly preferably made as a socket. Therefore, the socket is preferably arranged accessibly in the housing of the amplifier module, and particularly preferably can be closed by means of a cover. Also preferably, at least one operating element is arranged in the amplifier module, in particular arranged in the housing accessible from the outside in order to control the hearing aid, in particular to be able to switch between different operating programs or to adjust the amplification power of the hearing aid. The operating element can in particular be a knob, a switch or a pushbutton. Particularly preferably, a plurality of operating elements are arranged on the amplifier module.

The ear module always has means for generating an acoustic signal from an electric signal, in particular at least one, and preferably just one speaker according to the invention. Moreover means for forwarding the acoustic signal into the ear of the user can also be provided on the ear module. Preferably, an earpiece is arranged on the ear module that particularly preferably is made to be flexible, and/or elastic, and/or as an earbud tip.

The ear module can in principle have any shape and size as long as it is suitable to be worn in the ear. Preferably, the ear module is designed so that it can basically be introduced into the auditory canal. The ear module preferably has a housing shape and/or size adapted to be worn in the ear, or respectively in the auditory canal, wherein the shape can be standardized, as well as a shape adapted to the auditory canal of the particular user.

First of all, the electric circuits of the ear module and the amplifier module can be made as desired. Preferably, at least all electrical components of the amplifier module and/or the ear module, perhaps exclusively the microphone, each are arranged on a common printed circuit board.

The cable conduit module is first of all suitable to forward all electrical signals between the ear module and the amplifier module according to the invention. For this, the cable conduit module has at least one, preferably a plurality of conductor elements insulated from each other, in particular a plurality of cables and/or stranded wires. Preferably, the conductor elements are arranged jointly within a closed conduit. Also preferably, the cable conduit module is flexible, or respectively pliable. In principle, the cable conduit module can be made of any desired material and can have any desired color. Preferably, the cable conduit module is made of a plastic, and/or is transparent, or is colored in a skin tone.

The microphone can first of all be any desired device for picking up sounds to be amplified, wherein to do this, the microphone converts an acoustic signal, or respectively sound waves into an electric signal. The microphone is arranged in or on the ear module according to the invention, which is understood to be an arrangement in the spatial environment of the ear module and therefore in the position for use of an earpiece on or in the interior of the human ear. The microphone only has to be indirectly connected to the ear module, for example by a part of the cable conduit module. Preferably, the microphone is connected directly to the ear module.

According to the invention, the ear module, the cable conduit module and/or the amplifier module are releasably connected to each other and form a modular system with exchangeable parts. Very preferably, the ear module, the cable conduit module and the amplifier module are freely connectable with each other by standardized interfaces so that different modules can be freely combined with each other. Particularly preferably, the cable conduit module is separable from the ear module and/or from the amplifier module, and most preferably, the cable conduit module is connected in a reversibly separable and re-connectable manner with the ear module and/or the amplifier module.

A corresponding system of modules which are compatible with each other has numerous advantages: In principle, there are ear modules and amplifier modules in numerous shapes, sizes and colors depending on the fit and desire of the user. The cable conduit module also exists in different lengths, colors and shapes, or respectively thicknesses. Until now, a hearing aid acoustician needed to have a very large number of hearing aids in stock in order to be able to provide any desired combination, or respectively certain combinations, like for example a very small ear module in combination with a large amplifier module were previously unavailable. The modular construction of the invention with its at least two, preferably three individual modules that are separable from each other solves this problem. In addition, several different models of the modules can be advantageously combined with each other as long as they have interfaces that are compatible with each other.

According to an advantageous further embodiment of the hearing aid according to the invention, the microphone is arranged on a side of the housing opposite an earpiece of the ear module so that it is directed outward, i.e., outward from the auditory canal, and/or extends out of the auditory canal of the user when the ear module is in the wearing position in the ear of the user.

Likewise, a further embodiment of the invention is preferable in which the microphone is arranged in the interior of a housing of the ear module, whereby the microphone is easily protected from mechanical influences as well as from soiling and moisture. The housing of the ear module can be formed from several partial housings, wherein one of these partial housings can cover the microphone. The housing, in particular in the region of the microphone, can be opened at least sectionally, or respectively made so that sound can pass through the housing to the microphone. Particularly preferably, a protective cap is arranged as part of the housing in front of the microphone, or respectively at least partially surrounding the microphone.

A preferred embodiment of the hearing aid according to the invention provides that the microphone is arranged on a support arm arranged on the ear module and preferably rigid, wherein the support arm is particularly preferably made so that the microphone is held in the interior of the auricle of the user, whereby sound is picked up at a particularly advantageous position undisturbed by other components of the hearing aid. The support arm is thus preferably arranged fixed on the housing of the ear module, particularly preferably integrally bonded thereto, and most preferably welded therewith. Also preferably, the microphone is arranged on the end of the support arm and preferably in the interior of a microphone housing that is particularly preferably integrally bonded to the support arm, and most preferably welded therewith. In an especially preferred embodiment, the support arm is made flexible, or respectively malleable in order to be able to adapt the position of the microphone in the auricle.

In an advantageous embodiment of the hearing aid according to the invention, the cable conduit module has a connecting element, in particular a connecting plug to connect to the ear module, and/or the amplifier module at least at one end, preferably at both ends, which establishes electrical and/or mechanical connectability of the individual modules with each other, or respectively with the cable conduit module, in a particularly easy manner. Each connecting plug preferably has several contact elements, in particular poles, sockets and/or pins to forward signals and to connect to a corresponding socket of the ear module and/or the amplifier module. Particularly preferably, both connecting plugs have the same number of contact elements. Also preferably, both connecting elements, in particular both connecting plugs of the cable conduit module, are made identical to each other. Most preferably, each connecting element has six contact elements, in particular six pins. The contact elements preferably have a 2×3 arrangement, wherein the distance between adjacent connecting elements to each other is particularly preferably the same.

In a preferred embodiment of the hearing aid according to the invention, the cable conduit module is securely connected to the ear module, in particular fixed integrally thereto and preferably welded therewith so that the ear module and the cable conduit module form an inseparable unit. Such an embodiment can be advantageous when a particularly compact construction of the ear module is desirable since a connecting element is not required in the region of the ear module. Moreover, a fixed connection allows the cable conduit module to be shortened as desired by a technician followed by the fixed arrangement on the ear module, for example in the event that several standardized cable conduit modules do not fit.

Moreover, an embodiment of the hearing aid according to the invention is preferable in which the microphone is arranged on the connecting element of the cable conduit module, in particular on the connecting plug for connecting the cable conduit module to the ear module, whereby the microphone can on the one hand be advantageously moved from the ear module arranged in the auditory canal into the region of the auricle, and on the other hand, the microphone is arranged on a component separate from the ear module so that a system can be easily made in which different ear modules can be combined with different microphones.

According to an advantageous further embodiment of the hearing aid according to the invention, the connecting element, in particular the connecting plug, is fastened to the ear module and/or to the amplifier module by means of a removable locking pin, wherein the locking pin is preferably arranged in corresponding openings in the ear module or the amplifier module as well as the connecting element, in particular the connecting plug, whereby a permanent and reliable but simultaneously reversible connection can be easily created between two modules of the hearing aid. The opening for the locking pin in the ear module and/or in the amplifier module is preferably arranged in the housing, particularly preferably in a region surrounding a socket for accommodating the connecting plug.

In a preferred embodiment of the hearing aid according to the invention, the cable conduit module can be connected to the ear module and/or the amplifier module acoustically and/or mechanically decoupled, wherein preferably a socket for accommodating the connecting plug is arranged correspondingly decoupled from the ear module or the amplifier module, in particular the housing of the respective module, whereby the occurrence of feedback and resonance as well as mechanical vibrations can at least be easily reduced significantly and to an extent completely excluded. Preferably, the decoupling is achieved in that the component to be decoupled is fixed relative to the remainder of the module, in particular relative to its housing, entirely by an elastic and/or acoustically dampening material.

Moreover, an embodiment of the hearing aid according to the invention is also preferred in which the microphone is fixed in an acoustically and/or mechanically decoupled manner relative to the housing of the ear module or relative to the connecting element, in particular the connecting plug of the cable conduit module, wherein particularly preferably, a damping element is arranged between the microphone and the housing or the connecting element, in particular the connecting plug. The damping element is thus preferably a ring or a disk consisting of an elastic and/or acoustically damping and/or mechanically damping material.

In a preferred embodiment of the hearing aid according to the invention, at least one damping element is provided in the ear module, preferably a plurality of damping elements for mechanically and/or acoustically decoupling at least one acoustic component, for example the speaker and/or the microphone, from the other components of the ear module, such as the housing. Most preferably, all acoustic components of the ear module are mechanically and/or acoustically decoupled in order to avoid undesirable oscillations, vibrations or feedback.

Finally, an advantageous further embodiment of the hearing aid according to the invention provides that an induction coil is arranged in the amplifier module for detecting signals, whereby signals picked up by the induction coil can in addition or alternatively be advantageously processed and converted indirectly or directly into audible signals. Alternatively, the signals from the induction coil can also be used to correct and/or improve the signal picked up by the microphone. The induction coil can in particular be a telephone coil (t-coil).

Figure 2A:
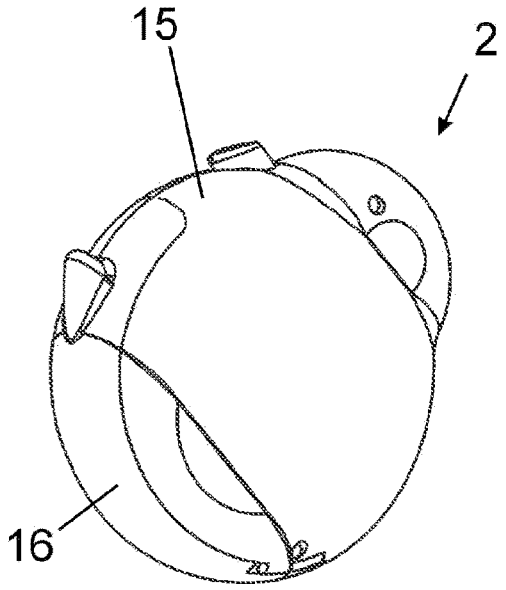
Figure 2B:
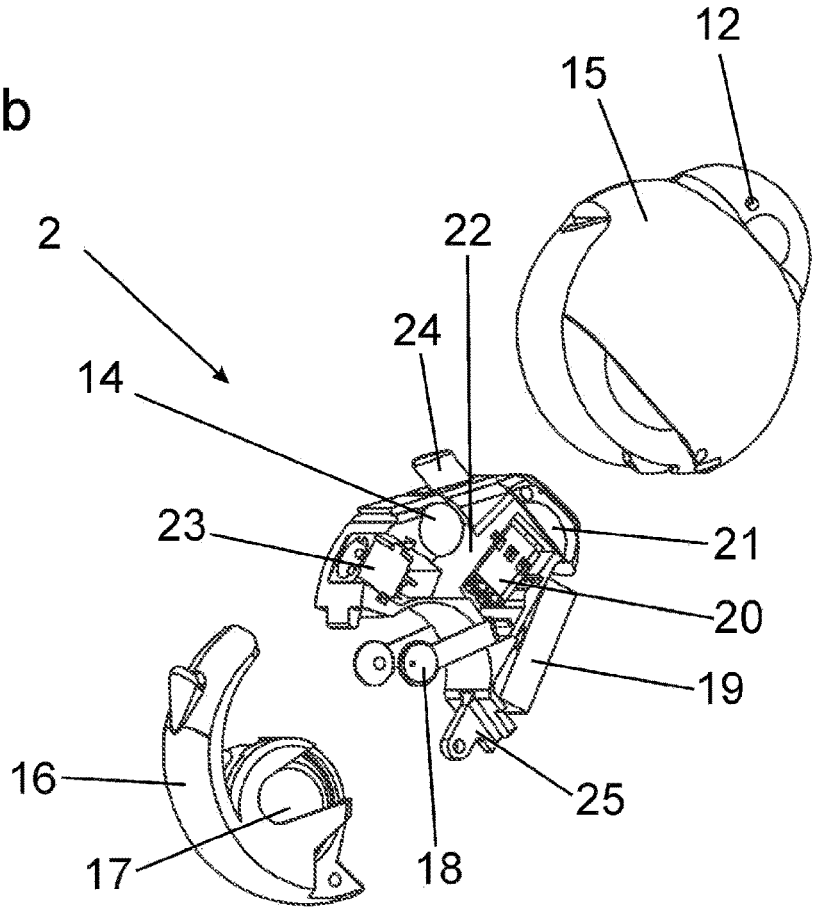
Figure 3A:
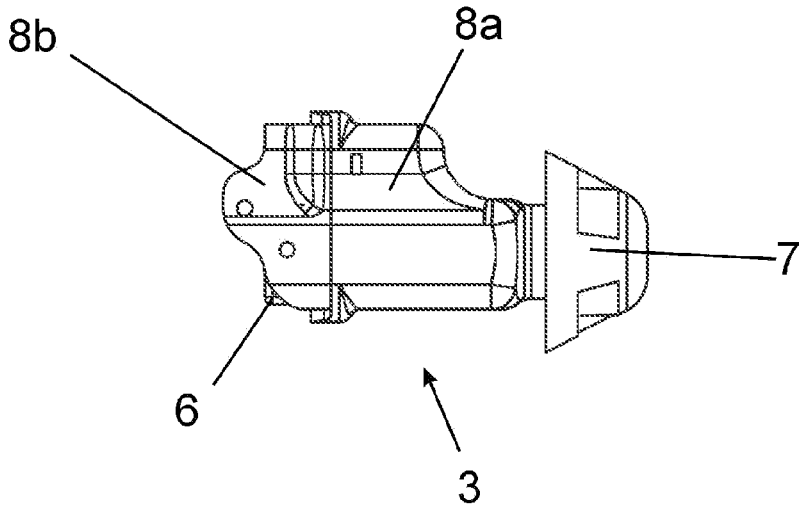
Figure 3B:
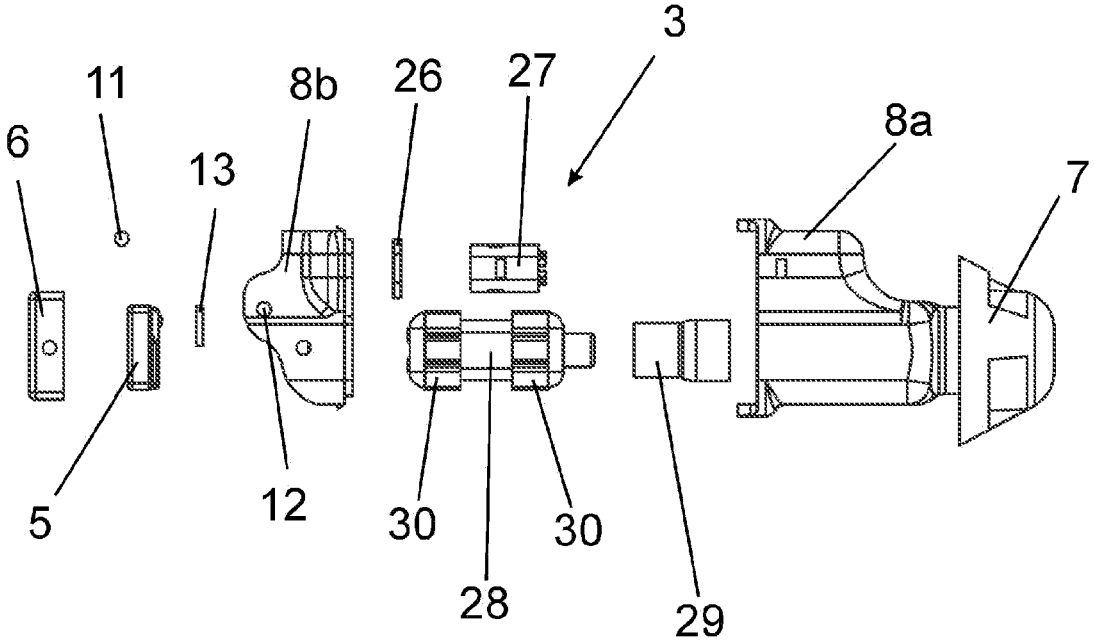
Figure 4A:
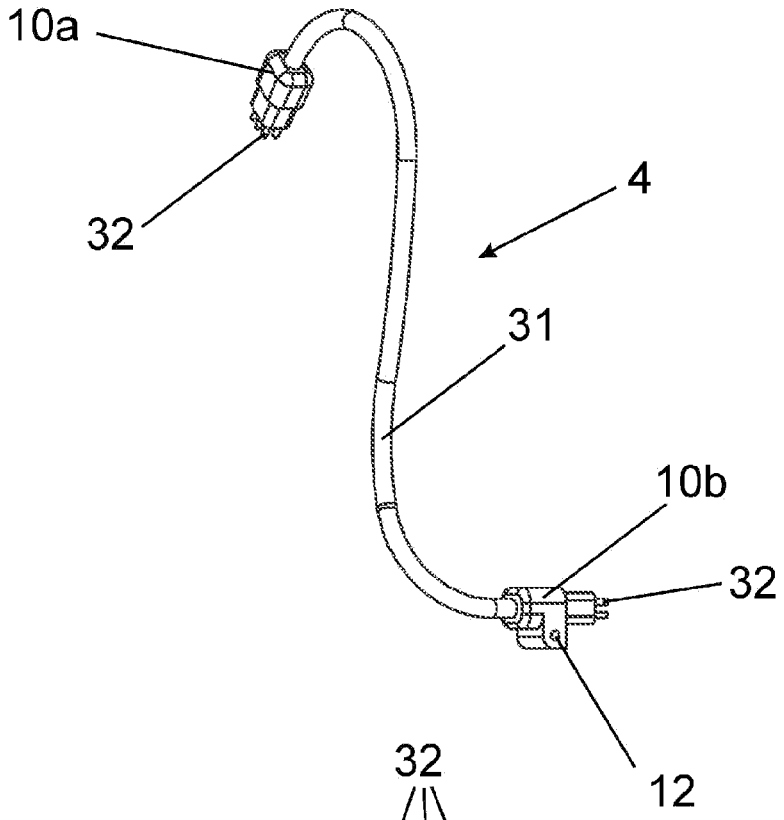
Figure 4B:
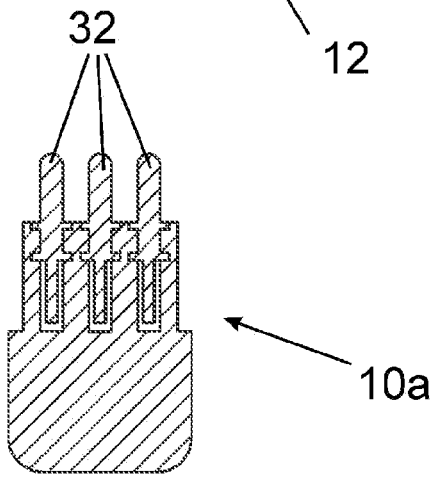
Figure 4C:
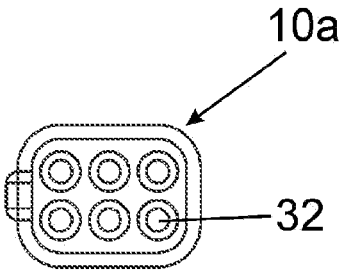
Figure 5A:
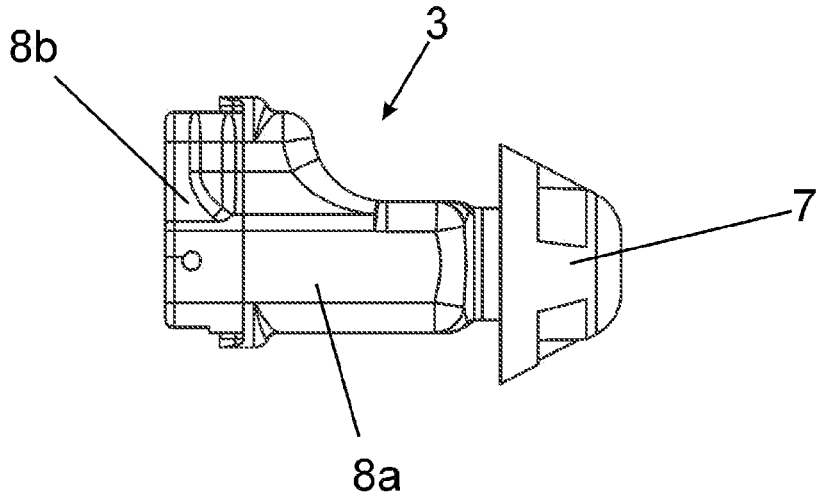
Figure 5B:
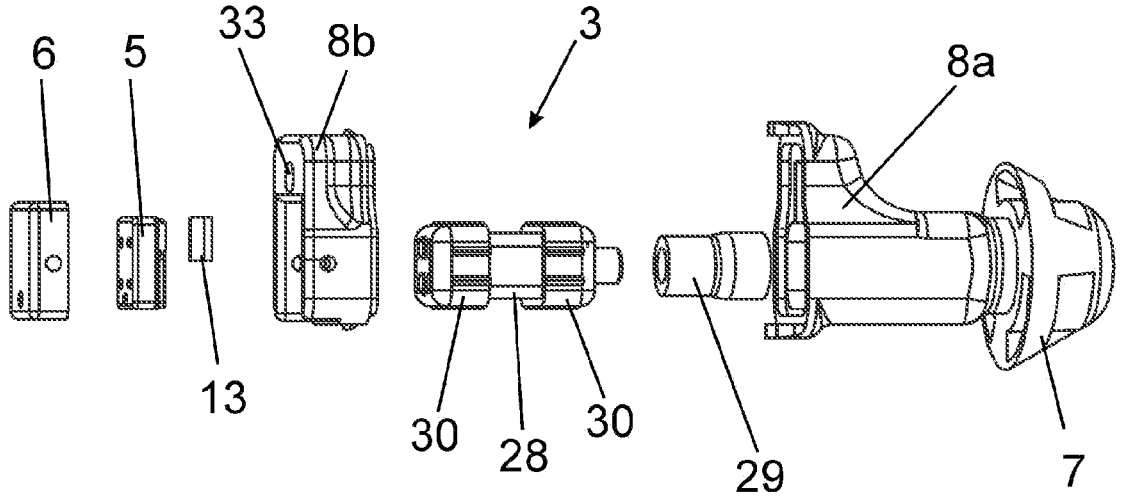
Figure 6A:
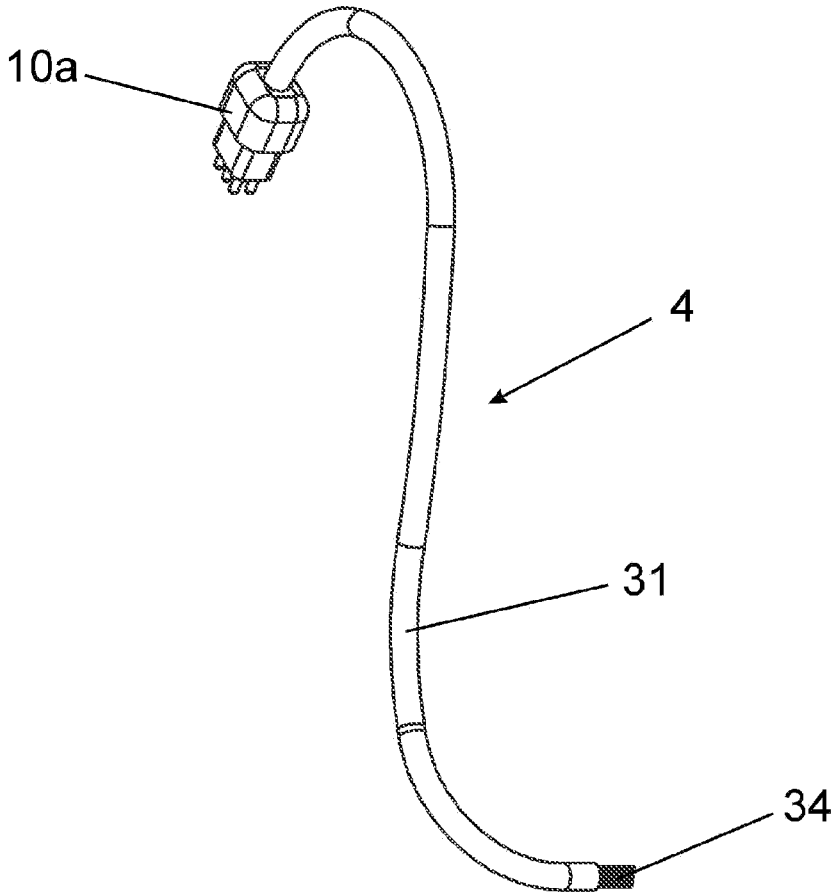
Figure 6B:
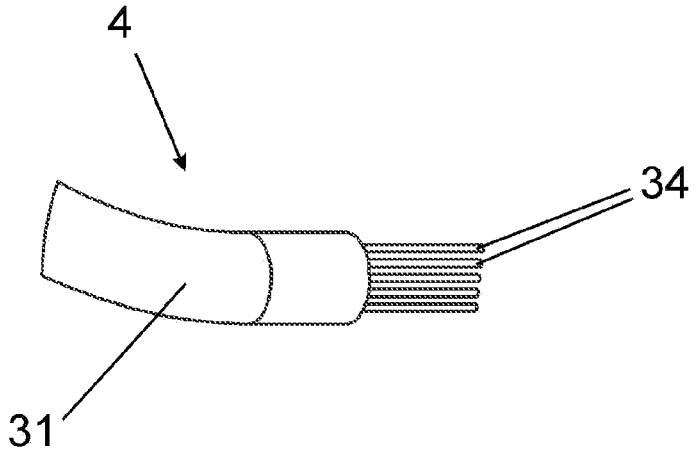
Figure 7:
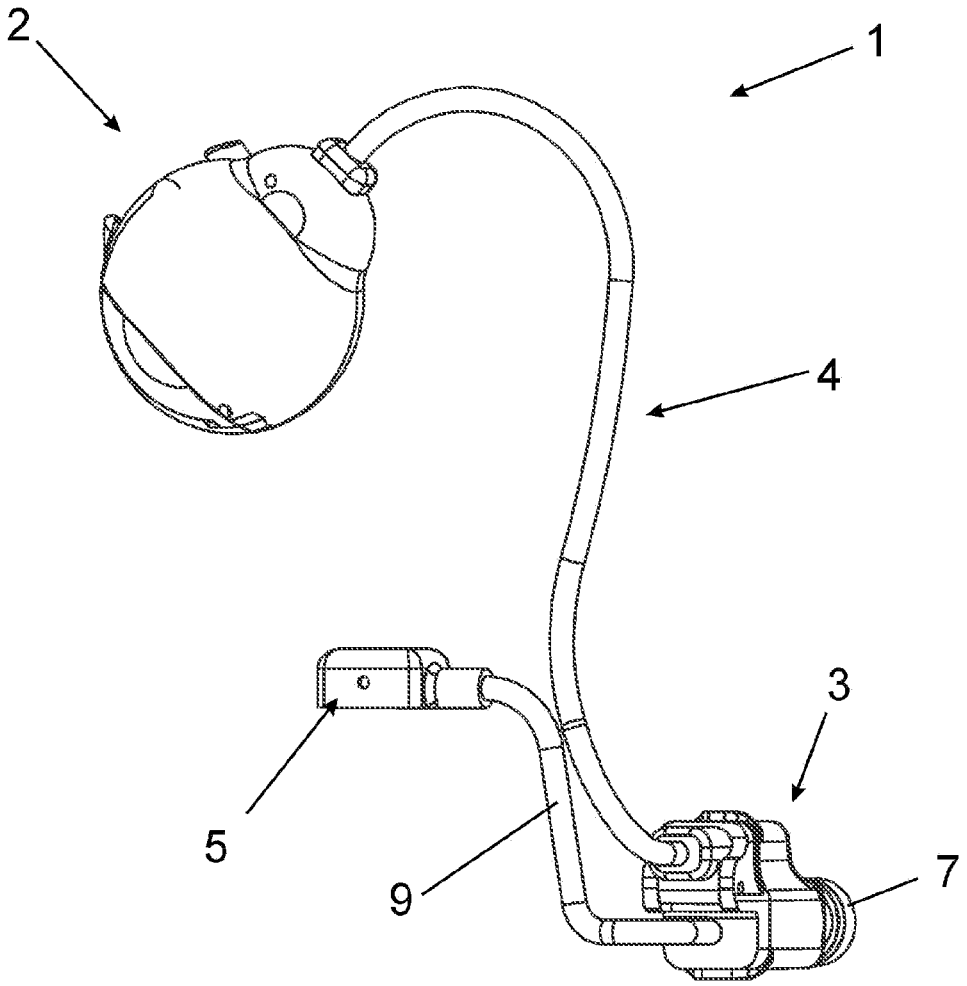
Figure 8A:
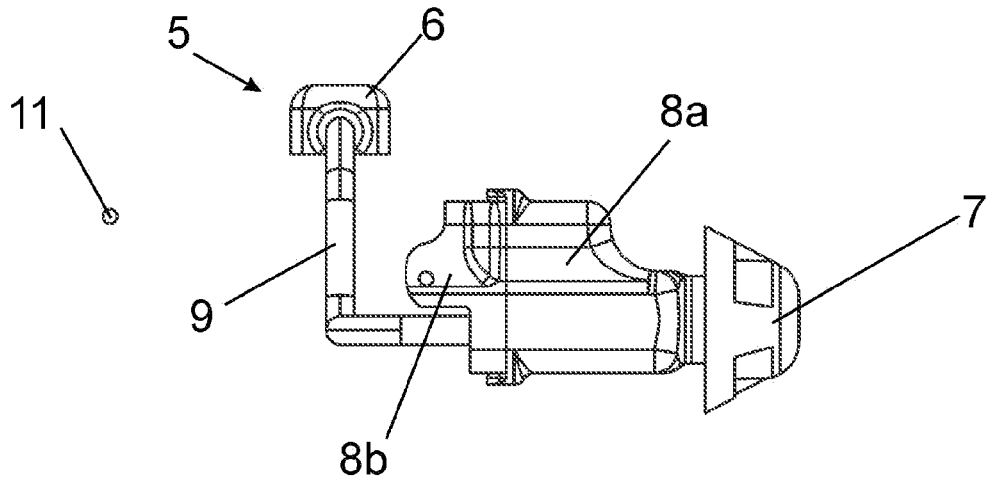
Figure 8B:
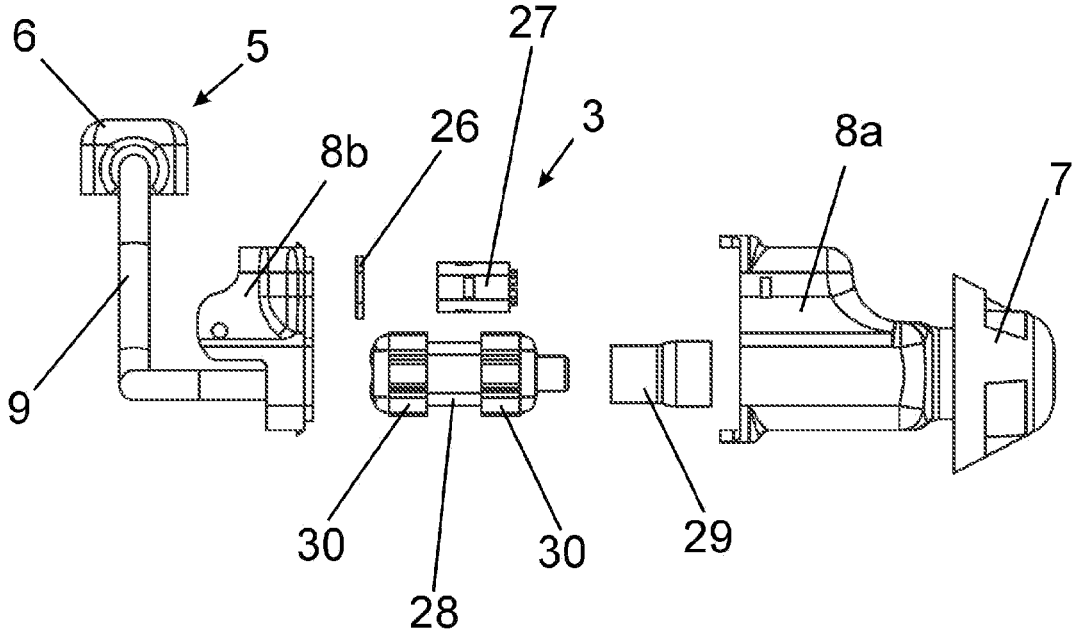
Figure 9:
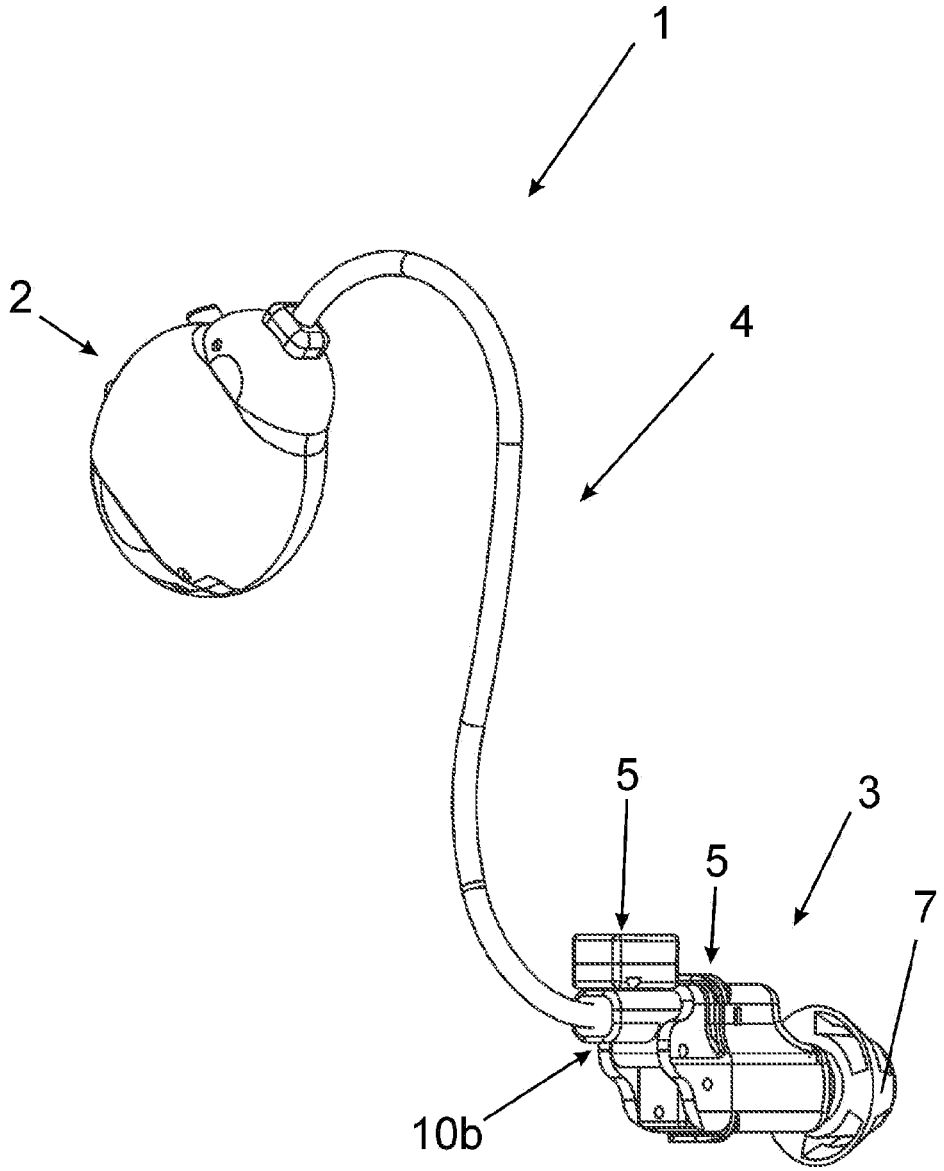
Figure 10A:
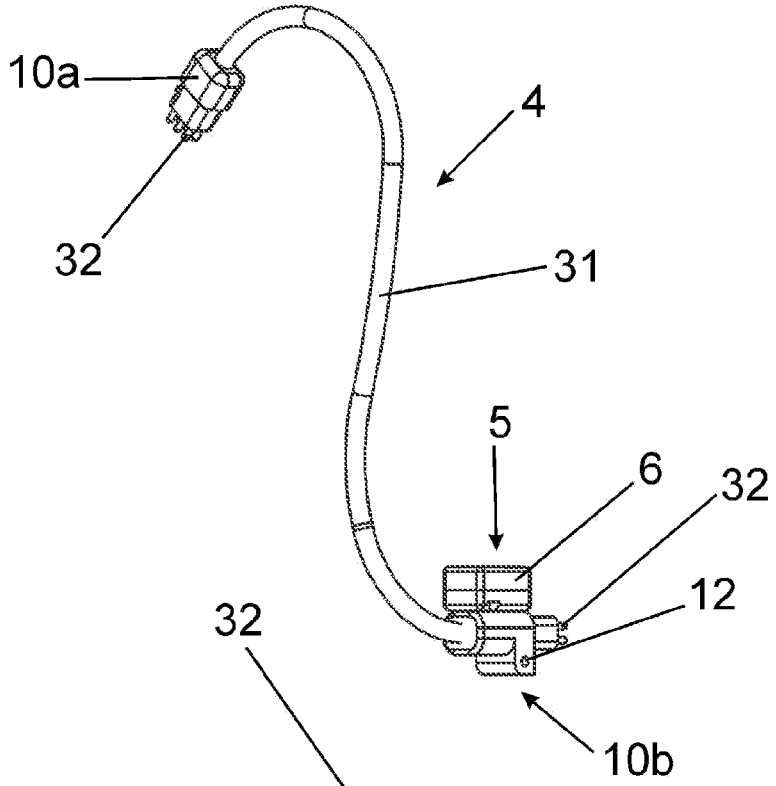
Figure 10B:
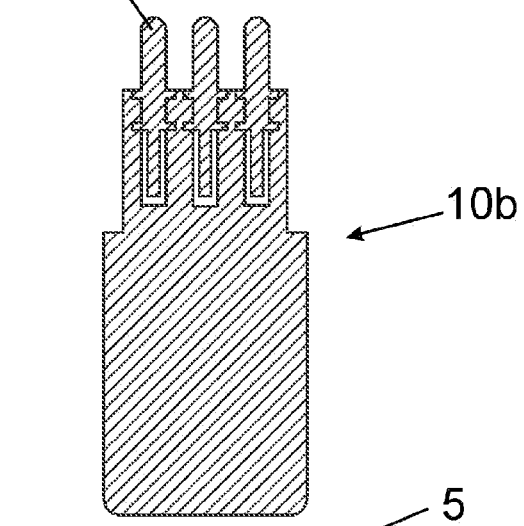
Figure 10C:
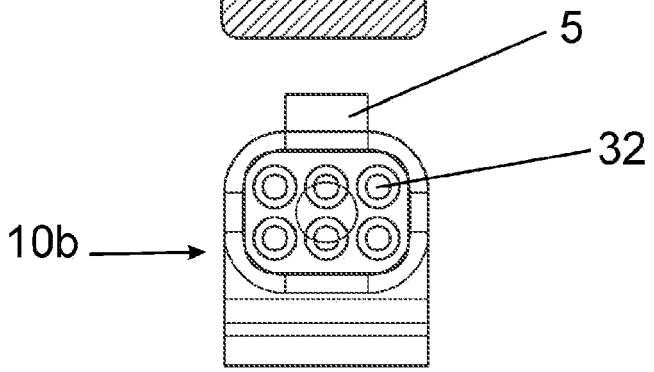

Four embodiments of the modular hearing aid according to the invention will be explained in greater detail below with reference to the drawings. In the figures:

FIG. 1 shows a perspective view of a first embodiment of a modular hearing aid, FIG. 2*a* shows a perspective view of an amplifier module of the hearing aid portrayed in FIG. 1, FIG. 2*b* shows a perspective exploded view of the amplifier module portrayed in FIG. 2*a*, FIG. 3*a* shows a perspective view of an ear module of the hearing aid portrayed in FIG. 1, FIG. 3*b* shows an exploded view of the ear module portrayed in FIG. 3*a*, FIG. 4*a* shows a perspective view of an cable conduit module of the hearing aid portrayed in FIG. 1, FIG. 4*b* shows a sectional view of a connecting element of the cable conduit module portrayed in FIG. 4*a*, FIG. 4*c* shows a front view of the connecting element portrayed in FIG. 4*b*, FIG. 5*a* shows a perspective view of an ear module of a second embodiment of a modular hearing aid, FIG. 5*b* shows an exploded view of the ear module portrayed in FIG. 5*a*, FIG. 6*a* shows a perspective view of a cable conduit module of the second embodiment of the modular hearing aid, FIG. 6*b* shows a detail view of an end of the cable conduit module portrayed in FIG. 6*a*, FIG. 7 shows a perspective view of a third embodiment of a modular hearing aid, FIG. 8*a* shows a side view of the ear module of the hearing aid portrayed in FIG. 7, FIG. 8*b* shows an exploded view of the ear module portrayed in FIG. 8*a*, FIG. 9 shows a perspective view of a fourth embodiment of a modular hearing aid, FIG. 10*a* shows a perspective view of a cable conduit module of the hearing aid portrayed in FIG. 9, FIG. 10*b* shows a sectional view of a connecting element of the cable conduit module portrayed in FIG. 10*a*, and FIG. 10*c* shows a front view of the connecting element portrayed in FIG. 10*b*.

In a first embodiment of a modular hearing aid 1 portrayed in perspective in FIG. 1, an amplifier module 2 and an ear module 3 are connected to each other by a cable conduit module 4, wherein all three modules 2, 3, 4 can be decoupled from each other and exchanged as desired for a corresponding module 2, 3, 4 and thereby jointly form a system of exchangeable individual modules 2, 3, 4.

A microphone 5 by means of which the sounds to be amplified are picked up is thus arranged in the ear module 3 provided for arrangement in the auditory canal of a user. Then the picked up sounds are transmitted as electrical signals through the cable conduit module 4 to the amplifier module 2 where the electrical signals are amplified and possibly processed, for example filtered in a frequency-selective manner. Then the amplified electrical signals are once again transmitted by the amplifier module 2 via the cable conduit module 4 to the ear module 3 and again converted therein into amplified acoustic signals. These acoustic signals are then fed into the auditory canal of the user through an earpiece 7.

The amplifier module 2 has a housing 15 that is substantially closed on all sides with a battery flap 16 (see FIG. 2*a*). A battery 17 can be inserted into the battery flap 16 and comes into contact with battery contacts 18 upon closing the battery flap 16, and the entire hearing aid 1 is supplied with power.

The battery contacts 18 as well as all of the components of the amplifier module 2 are thus arranged on a base support 25 which can be inserted into the housing 15. The electrical components, inter alia a hybrid, or respectively amplifier 19 for amplifying the signal picked up by the microphone 5 and an induction coil 14 for picking up background noises in the region of the amplifier module 2 are arranged on a common printed circuit board 22 (see FIG. 2*b*).

The amplifier module 2 is connected to the cable conduit module 4 by a connector 20 made as a socket which is acoustically and mechanically decoupled from the other components of the amplifier module 2 by means of a decoupling element 21 consisting of an elastic plastic.

Moreover, a programming interface 23 in the form of a connecting socket is arranged on the base support 25 and is accessible when the base support 25 is removed from the housing 15 of the amplifier module 2. Moreover, the amplifier module 2 has a pushbutton as an operating element 24 which extends out of the closed housing 15, and by means of which different operating modes or the amplification performance of the hearing aid 1 can be set.

The ear module 3 also has a housing 6, 8 that is substantially closed on all sides and on which the cable conduit module 4 can be arranged at one end, and the earpiece 7 is secured to the other end (see FIG. 3*a*). The housing 6, 8 is made of a microphone housing 6 covering the microphone 5 as well as two housing parts 8*a*, *b* covering the other part of the ear module 3, wherein the microphone housing 6 has openings, at least sectionally, and/or is made such that sound can pass through the microphone housing 6 to the microphone 5.

The microphone 5 is acoustically and mechanically decoupled from the remaining part of the ear module 3 by a damping element 13 consisting of an elastic plastic. Moreover, a connector 27 made as a socket is also mechanically and acoustically decoupled by a decoupling element 26 from the housing part 8*b*, or respectively the other components of the ear module 3 (see FIG. 3*b*).

The electrical signal amplified by the amplifier module 2 is transmitted by the cable conduit module 4 and the connector 27 to a receiver, or respectively loudspeaker 28 arranged in the ear module 3, and converted there into an acoustic signal. Then the acoustic signal is forwarded by a vibration-dampened sound conductor 29 to the earpiece 7 arranged on the housing part 8*a* where it enters the auditory canal of the user. The receiver, or respectively speaker 28 is also acoustically and mechanically decoupled from the other components, in particular from the housing 8*a*, *b*, by means of decoupling elements 30 consisting of an elastic plastic.

The cable conduit module 4 is in principle made of a transparent plastic conduit 31 in which are arranged six mutually insulated strands 34. Connecting plugs 10*a*, *b* are attached to both ends of the cable conduit module 4 (see FIG. 4*a*). Each of the connecting plugs 10*a*, *b* has six metal contact pins 32 in a 2×3 arrangement (see FIGS. 4*b* and 4*c*).

To reversibly connect the cable conduit module 4 to the amplifier module 2, or respectively to the ear module 3, both the respective connecting plug 10 as well as the housing 15 of the amplifier module 2, or respectively the housing 8 of the ear module 3 has an opening 12 which, when the connecting plug 10 is connected, are arranged such that a locking pin 11 can simultaneously be shoved through the openings 12 in both components 10 and 15, or respectively 8.

A second embodiment of the modular hearing aid 1 according to the invention differs from the first embodiment only in that the cable conduit module 4 is not connected to the ear module 3 by a connecting plug 10; instead, the conduit 31 of the cable conduit module 4 is guided directly into a cable opening 33 in the housing 8*b* of the ear module 3 where the cable conduit module 4 is welded to the ear module 3 (see FIG. 5*a*, *b*). Correspondingly, a particularly compact construction of a corresponding ear module 3 is possible since, inter alia, a connector 27 made as a socket is unnecessary. In order to establish an electrical connection between the cable conduit module 4 and the ear module 3, the individual strands 34 (see FIG. 6*a*, *b*) guided in the conduit 31 are soldered directly to the microphone 5 and the receiver, or respectively speaker 28 in the ear module 3.

A third embodiment of the hearing aid 1 according to the invention portrayed in FIG. 7 differs from the first embodiment only in that the microphone 5 is not secured directly on the housing 6, 8 of the ear module 3 but is instead connected by a support arm 9 to the ear module 3, or respectively its housing 8 so that the microphone 5 can be arranged at the entrance of the auditory canal or at any other position in the auricle of the user. To accomplish this, one end of the support arm 9 is secured to an end of the housing 8*b* of the ear module 3 opposite the earpiece 7. At the other end of the support arm 9, the microphone 5 is arranged within a microphone housing 6 (see FIG. 8*a, b*). The support arm 9 thus has three right angles in a basic configuration, in particular angled in a different direction in space in each case, and can preferably be bent into any position.

Finally in a fourth embodiment of the hearing aid 1 according to the invention portrayed in FIG. 9, the microphone 5 is not arranged on the ear module 3, but rather on the connecting plug 10*b* of the cable conduit module 4 that is provided for connecting to the ear module 3. Given the modular construction of the hearing aid 1, the connecting plug 10*b* is however made such that an ear module 3 with an integrated microphone 5 can also be used, as it is for example employed in the first embodiment. In such a case, one microphone 5 is then arranged on the cable conduit module 4 and another microphone 5 is arranged on the ear module 3, wherein the microphone 5 of the ear module 3 can both be deactivated as well as operated in addition to the microphone 5 on the cable conduit module 4.

To establish compatibility with all ear modules 3 of the system, the connecting plug 10*b* of this embodiment of the cable conduit module 4 also has six contact pins 32 (see FIG. 10*a, b, c*), wherein however the signals picked up by the microphone 5 arranged on the cable conduit module 4 are forwarded directly to the amplifier module 2.

REFERENCE SIGN LIST

1 Modular hearing aid
2 Amplifier module
3 Ear module
4 Cable conduit module
5 Microphone
6 Microphone housing of the ear module
7 Earpiece
8*a, b* Housing of the ear module
9 Support arm
10*a, b* Connecting plug
11 Locking pin
12 Opening for the locking pin
13 Damping element
14 Induction coil
15 Housing of the amplifier module
16 Battery flap
17 Battery
18 Battery contact
19 Hybrid/amplifier
20 Connector
21 Decoupling element
22 Printed circuit board
23 Programming interface
24 Control element
25 Base support
26 Decoupling element
27 Connector
28 Receiver/speaker
29 Vibration-damping sound conductor
30 Decoupling element
31 Conduit
32 Contact pin
33 Cable opening
32 Strands

The invention claimed is:

1. A modular hearing aid having:
an amplifier module that can be worn behind the ear,
an ear module for arrangement in the ear, and
a cable conduit module for connecting the amplifier module to the ear module,
wherein
a microphone for picking up sounds and a speaker are arranged in or on the ear module,
wherein
the cable conduit module is made to forward electrical signals picked up by the microphone to the amplifier module, and to forward amplified electrical signals from the amplifier module to the ear module,
the ear module, the cable conduit module and the amplifier module are releasably connected to each other and thus form a modular system consisting of respectively exchangeable parts, and
an induction coil is arranged in the amplifier module for detecting signals.

2. The modular hearing aid according to claim 1, wherein the ear module, the cable conduit module and the amplifier module are connectable to each other by standard interfaces.

3. The modular hearing aid according to claim 1, wherein the microphone is arranged in the interior of a housing of the ear module, wherein the microphone is arranged on a side of the housing opposite an earpiece of the ear module.

4. The modular hearing aid according to claim 1, wherein the microphone is arranged on a rigid support arm arranged on the ear module.

5. The modular hearing aid according to claim 1, wherein the cable conduit module for connecting to the ear module and/or the amplifier module has a connecting plug on at least one end, or on both ends.

6. The modular hearing aid according to claim 5, wherein the microphone is arranged on the connecting plug for connecting the cable conduit module to the ear module.

7. The modular hearing aid according to claim 5, wherein the connecting plug is fastened to the ear module and/or to the amplifier module by a removable locking pin, wherein the locking pin is arranged in corresponding openings in the ear module or the amplifier module as well as the connecting plug.

8. The modular hearing aid according to claim 5, wherein the cable conduit module can be connected acoustically and/or mechanically decoupled to the ear module and/or the amplifier module, wherein a socket for accommodating the connecting plug is arranged decoupled relative to the ear module or the amplifier module.

9. The modular hearing aid according to claim 5, wherein the microphone is fixed in an acoustically and/or mechanically decoupled manner relative to the housing of the ear module or relative to the connecting plug of the cable conduit module, wherein a damping element is arranged between the microphone and the housing or the connecting plug.

10. A modular hearing aid having:
an amplifier module that can be worn behind the ear,
an ear module for arrangement in the ear, and
a cable conduit module for connecting the amplifier module to the ear module,
wherein a microphone for picking up sounds and a speaker are arranged in or on the ear module, wherein the cable conduit module is made to forward electrical signals picked up by the microphone to the amplifier module, and to forward amplified electrical signals from the amplifier module to the ear module, the ear module, the cable conduit module and the amplifier module are releasably connected to each other and thus form a modular system consisting of respectively exchangeable parts, and the microphone is arranged on a rigid support arm arranged on the ear module.

* * * * *